United States Patent [19]

Clarke

[11] Patent Number: 4,477,538

[45] Date of Patent: Oct. 16, 1984

[54] PLATINUM UNDERLAYERS AND OVERLAYERS FOR COATINGS

[75] Inventor: Robert L. Clarke, Riva, Md.

[73] Assignee: The United States of America as represented by the Secretary of the Navy, Washington, D.C.

[21] Appl. No.: 235,051

[22] Filed: Feb. 17, 1981

[51] Int. Cl.³ ..... B32B 0/4

[52] U.S. Cl. ..... 428/656; 428/670; 428/678; 428/680; 428/685

[58] Field of Search ..... 428/670, 678–685, 428/656

[56] References Cited

U.S. PATENT DOCUMENTS

| | | | |
|---|---|---|---|
| 3,819,338 | 6/1974 | Bungardt et al. | 428/670 |
| 3,890,456 | 6/1975 | Dils | 428/670 |
| 3,999,956 | 12/1976 | Stueber et al. | 428/670 |
| 4,123,594 | 10/1978 | Chang | 428/670 |

FOREIGN PATENT DOCUMENTS

| | | | |
|---|---|---|---|
| 55-82773 | 6/1980 | Japan | 428/670 |

OTHER PUBLICATIONS

Kubaschewski, O.; et al.; *Oxidation of Metals and Alloys* 2nd edition, Academic Press, London, p. 1, (1962).

*Primary Examiner*—Michael L. Lewis

*Attorney, Agent, or Firm*—R. F. Beers; L. A. Marsh; R. F. Beers

[57] ABSTRACT

A coating for nickel/cobalt base alloys used in gas turbine constructions comprises a platinum metal underlayer, an intermediate MCrAlY layer, and a platinum metal overlayer. The platinum type metal is selected from the group consisting of platinum, rhodium, palladium and/or iridium. The MCrAlY material consists of yttrium (Y), aluminum (Al), chromium (Cr) and a balance represented by the letter (M) and selected from the group cobalt, iron and nickel.

6 Claims, 1 Drawing Figure

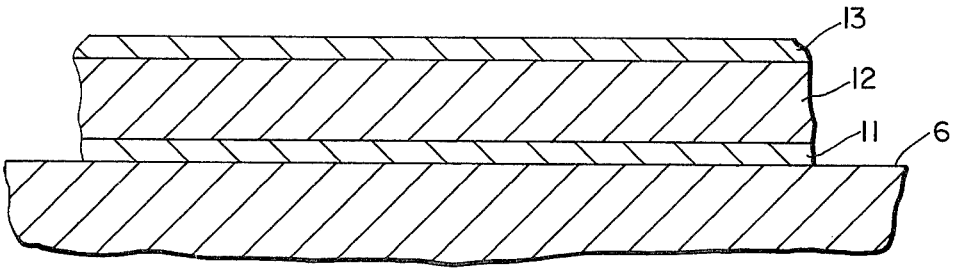
13
12
11
6

PLATINUM UNDERLAYERS AND OVERLAYERS FOR COATINGS

BACKGROUND OF THE INVENTION

This invention generally relates to alloys used as coatings for gas turbine engine components and, more particularly, to coatings of MCrAlY alloys that are resistant to hot corrosion oxidation and sulfidation at high temperatures.

Components of gas turbines such as blades and vanes are often constructed from high strength alloys. However, many of these materials, such as the nickel-cobalt based alloys, are susceptible to high-temperature oxidation and corrosion.

Accordingly, it is a normal practice to coat the turbine components with oxidation and corrosion resistant materials such as the MCrAlY alloys, as exemplified by U.S. Pat. Nos. 3,649,225; 3,676,085; 3,754,903; 3,918,139; 4,005,989; 4,101,715 and 4,214,042. Typically, the MCrAlY coatings comprise small proportions of yttrium (on the order of 1–2%), relatively larger proportions of chromium and aluminum (on the order of 15–40% and 10–25% respectively), and the remaining balance selected from the group of cobalt, nickel or iron and represented by the letter M. The MCrAlY coatings are normally applied as overlay coatings in which the MCrAlY alloy is deposited on the substrate by various techniques such as vacuum vapor deposition, sputtering, and plasma spray deposition as disclosed, for example, in U.S. Pat. Nos. 3,873,347; 4,101,713; 4,101,715; 4,145,481; 4,152,488 and 4,198,442.

It has also been suggested that additional coating improvements are possible through the use of multiple coating layer and composite coatings. For example, U.S. Pat. No. 3,649,225 describes a coating comprising a chromium rich interlayer interposed between an alloy substrate and an aluminized MCrAlY overlayer. Another "stratified" coating is disclosed in U.S. Pat. No. 4,005,989 wherein an aluminide interlayer is disposed between a nickel/cobalt substrate and an MCrAlY overlayer. Composite coatings employing platinum group metals are disclosed in U.S. Pat. Nos. 3,677,789; 3,819,338; 3,829,969 and 3,918,139. For example, U.S. Pat. Nos. 3,677,789; and 3,819,338 disclose a coating process for nickel and/or cobalt alloy substrates wherein a thin platinum layer is deposited on the substrate followed by diffusion of aluminide into the platinum layer.

SUMMARY OF THE INVENTION

The composite coating of the present invention comprises a platinum group underlayer applied to a substrate, an MCrAlY layer applied over the noble metal underlayer, and a platinum group overlayer applied to the intermediate MCrAlY layer. The platinum type metal is selected from the group consisting of platinum, rhodium, palladium and/or iridium. The MCrAlY coating consist of a small proportion of yttrium and/or other rare earth elements, relatively larger proportions of chromium and aluminum, and a balance selected from the group of cobalt, nickel and/or iron.

Accordingly, an object of the present invention is to provide metal articles which resist corrosion and oxidation under elevated operating temperatures.

Another object of this invention is to provide a durable composite coating which can be utilized without embrittlement, spalling and cracking under various operating conditions.

BRIEF DESCRIPTION OF THE DRAWING

The novel features which are believed to be characteristic of this invention are set forth with particularity in the appended claims. The invention, however, both as to its organization and method of operation disclosed herein, together with further objects and advantages thereof, may be best understood by reference to the following description taken in conjunction with the accompanying drawing, which is a sectional view of the composite coating applied to a suitable substrate.

DETAILED DESCRIPTION OF THE INVENTION

Referring now to the drawing there is shown a durable composite coating applied to a substrate 6 and comprising a platinum metal underlayer 11, an intermediate MCrAlY-alloy layer 12, and a platinum metal overlayer 13.

Applicable substrates 6 for the coating of the present invention are generally characterized as nickel, cobalt or iron base alloys that exhibit high strength at high temperatures.

These alloys have been found to be particularly useful for gas turbine constructions where the blades are subject to problems associated with differential thermal expansions and contractions, fatique and other stress failures, errosion, and corrosion occurring in NaCl and $Na_2SO_4$ environments.

Specific examples of suitable nickel-base alloys used for gas turbine constructions include:

(1) Inconel alloy 792, which has a composition in terms of weight percent of 13% chromium, 10% cobalt, 4.5% titanium, 4% tantallum, 4% tungsten, 3% aluminum, 2% molybdenum, 0.2% carbon, 0.1% zirconium, 0.02% boron, and a balance of nickel;

(2) RENE' 80, which has a composition of about 14% chromium, 9.5% cobalt, 5% titanium, 4% molybdenum, 4% tungsten, 3% aluminum, 0.17% carbon, 0.015% boron, 0.03% zirconium, and a balance of nickel;

(3) MAR-M 200, which has a composition of about 9% chromium, 10% cobalt, 2% titanium, 5% aluminum, 12.5% tungsten, 0.15% carbon, 1% columbium, 0.015% boron, 0.05% zirconium, and a balance of nickel; and (4) IN-100, which consists of about 10% chromium, 15% cobalt, 4.5% titanium, 5.5% aluminum, 3% molybdenum, 0.17% carbon, 1% vanadium, 0.06% boron, 0.05% zirconium, and a balance of nickel.

Examples of cobalt-base alloys used in gas turbine constructions include:

(1) X-40, which comprises about 25.5% chromium, 10.5% nickel, 7.5% tungsten, 0.75% manganese, 0.75% silicon, 0.50% carbon, and a balance of cobalt; and (2) MAR-M509, which comprises about 21.5% chromium, 10% nickel, 7% tungsten, 3.5% tantalum, 0.2% titanium, 0.6% carbon, 0.5% zirconium, and a balance of cobalt.

The composite coating is deposited on the substrate materials by first applying a thin layer 11 of a platinum type metal selected from the group consisting of platinum, iridium, palladium and rhodium. Although various deposition processes are well known the preferred method involves electroplating, as disclosed, for example, in U.S. Pat. No. 3,309,292, wherein the platinum group metal is applied to the substrate in an electrolytic plating bath. For optimum performance this underlayer should have a thickness of between about 0.0002 to 0.0007 inches (or about 0.2 to 0.7 mils). While the degree of protection afforded by the platinum metal underlayer 11 is largely dependent upon the amount of platinum metal available in the layer, another consideration is the necessity of providing a firm base for the MCrAlY overlayer, particularly where the structure is subject to thermal shock and differential stress conditions. Other design consideration are that the platinum coating is economical to apply, ductile, and of reasonable thickness so that it is not subject to spallation and cracking.

The intermediate MCrAlY layer 12 is applied to the platinum metal underlayer 11 by well known deposition techniques such as vacuum vapor deposition, sputtering, and plasma spray processes. Examples of such techniques are disclosed in U.S. Pat. Nos. 3,873,347; 4,101,713; 4,101,715; 4,145,481; 4,152,488; and 4,198,442; and the relevant teachings thereof are herein incorporated by reference.

The MCrAlY coating material preferably consists of yttrium (Y), aluminum (Al), chromium (Cr) and a balance selected from the group of cobalt, iron and/or nickel and represented by the letter (M). Suitable CoCrAlY coatings preferably have a composition range, by weight percent, of about 20 to 40% chromium, about 5 to 15% aluminum, about 0.1 to 0.5% yttrium, and a balance of cobalt. A preferred example of a CoCrAlY coating consists of about 25 to 30% chromium, about 10 to 14% aluminum, about 0.1 to 0.5% yttrium, and a balance of cobalt. The FeCrAlY coatings should have a composition range, by weight percent, of between about 20 to 35% chromium, about 5 to 15% aluminum, about 0.1 to 0.7% yttrium, and a balance of iron. Further, the NiCrAlY coatings should have a composition range, by weight percent, of between about 20 to 45% chromium, about 5 to 15% aluminum, about 0.1 to 0.5% yttrium and a balance of nickel. A more particular example of a suitable NiCrAlY coating consists of between about 38 to 45% chromium, 8 to 12% aluminum, 0.1 to 0.5% yttrium, and a balance of nickel.

A preferred coating process for the MCrAlY material 12 involves the vapor deposition of molten MCrAlY material onto the preheated platinum metal substrate 11 in a vacuum chamber until the desired coating thickness is achieved.

The intermediate MCrAlY layer 12 should have a coating thickness of between about 0.002 to 0.008 inches (2 to 8 mils), and preferably on the order of about four to six mils. While thinner coatings may not provide adequate protection, coatings which are thicker than the above-mentioned thickness range have been found to crack and spall when subjected to environments existing in gas turbine engines. After deposition of the intermediate MCrAlY layer 12, the coated structure may be subjected to a diffusion heat treatment at a temperature selected to affect not only the MCrAlY layer 12 but perhaps the platinum metal underlayer 11 and the substrate 6 as well.

Subsequently, a platinum group overlayer 13 is applied to the intermediate MCrAlY layer 12, wherein the platinum type metal is selected from the group consisting of platinum, iridium, palladium and rhodium. For optimum performance the overlayer 13 should have a thickness of between about 0.0002 to 0.0007 inches (or about 0.2 to 0.7 mils).

Obviously many modifications and variations of the present invention are possible in light of the above teachings. It is therefore to be understood that within the scope of the appended claims the invention may be practiced otherwise than as specifically described.

What is claimed is:

1. A composite article of manufacture consisting of a coating applied to a substrate for use in high temperature, corrosive environments said coating consisting of:

a platinum type metal underlayer applied to the substrate, said platinum type metal material selected from the group consisting of platinum, palladium, iridium, and rhodium;

an MCrAlY alloy intermediate layer applied to the platinum type metal underlayer, said MCrAlY alloy consisting of chromium, aluminum, at least one element selected from the group consisting of yttrium and the rare earth elements, and the balance (M) selected from the group consisting of cobalt, iron, and nickel; and a platinum type metal overlayer applied to the MCrAlY intermediate layer, said platinum type metal selected from the group consisting of platinum, palladium, iridium, and rhodium, wherein the MCrAlY intermediate layer consists of, by weight, about 20–40% chromium, about 5–15% aluminum, about 0.1–0.5% yttrium, and the balance of cobalt.

2. The composite article of manufacture according to claim 1, wherein the platinum type metal underlayer has a coating thickness of from about 0.2 to about 0.7 mils, the MCrAlY intermediate layer has a coating thickness of from about 2.0 to about 8.0 mils, and the platinum type overlayer has a coating thickness of from about 0.2 to about 0.7 mils.

3. A composite article of manufacture consisting of a coating applied to a substrate for use in high temperature, corrosive environments said coating consisting of:

a platinum type metal underlayer applied to the substrate, said platinum type metal material selected from the group consisting of platinum, palladium, iridium, and rhodium;

an MCrAlY alloy intermediate layer applied to the platinum type metal underlayer, said MCrAlY alloy consisting of chromium, aluminum, at least one element selected from the group consisting of yttrium and the rare earth elements, and the balance (M) selected from the group consisting of cobalt, iron, and nickel, and a platinum type metal overlayer applied to the MCrAlY intermediate layer, said platinum type metal selected from the group consisting of platinum, palladium, iridium, and rhodium, wherein the MCrAlY intermediate layer consists of, by weight, from about 20% to about 35% chromium, from about 5% to about 15% aluminum, about 0.1–0.7% yttrium, and the balance of iron.

4. The composite article of manufacture according to claim 3, wherein the platinum type metal underlayer has a coating thickness of between about 0.2 and 0.7 mils, the MCrAlY intermediate layer has a coating thickness of between about 2.0 to about 8.0 mils, and the platinum type metal overlayer has a coating thickness of between about 0.2 and about 0.7 mils.

5. A composite article of manufacture consisting of a coating applied to a substrate for use in high temperature, corrosive environments said coating consisting of:

a platinum type metal underlayer applied to the substrate, said platinum type metal material selected from the group consisting of platinum, palladium, iridium, and rhodium;

an MCrAlY alloy intermediate layer applied to the platinum type metal underlayer, said MCrAlY alloy consisting of chromium, aluminum, at least one element selected from the group consisting of yttrium and the rare earth elements, and the balance (M) selected from the group consisting of cobalt, iron, and nickel; and a platinum type metal overlayer applied to the MCrAlY intermediate layer, said platinum type metal selected from the group consisting of platinum, palladium, iridium, and rhodium, wherein the MCrAlY intermediate layer consists of, by weight, from about 20.0% to about 45.0% chromium, from about 5.0% to about 15% aluminum, from about 0.1% to about 0.5% yttrium, and the balance of nickel.

6. The composite article of manufacture according to claim 5, wherein the platinum type metal underlayer has a coating thickness of between from about 0.2 to about 0.7 mils, the MCrAlY intermediate layer has a coating thickness of from between about 2.0 to about 8.0 mils, and the platinum type metal overlayer has a coating thickness of from about 0.2 to about 0.7 mils.

* * * * *